US011525285B2

(12) United States Patent
Chen et al.

(10) Patent No.: US 11,525,285 B2
(45) Date of Patent: Dec. 13, 2022

(54) INTERCONNECTED DOOR LOCK

(71) Applicant: DORMAKABA USA INC., Indianapolis, IN (US)

(72) Inventors: (Sam Chen) Po-Yang Chen, Chiayi (TW); (Kate) Kai-Ting Tung, Chiayi (TW); (Steven) Ming-Che Chen, Chiayi (TW); (Newman) Cheng-Wen Lai, Chiayi (TW)

(73) Assignee: dormakaba USA Inc, Indianapolis, IN (US)

( * ) Notice: Subject to any disclaimer, the term of this patent is extended or adjusted under 35 U.S.C. 154(b) by 352 days.

(21) Appl. No.: 16/472,302

(22) PCT Filed: Jan. 9, 2017

(86) PCT No.: PCT/US2017/012738
§ 371 (c)(1),
(2) Date: Jun. 21, 2019

(87) PCT Pub. No.: WO2018/128633
PCT Pub. Date: Jul. 12, 2018

(65) Prior Publication Data

US 2021/0148140 A1 May 20, 2021

(51) Int. Cl.
*E05B 59/00* (2006.01)
*E05B 15/02* (2006.01)
(Continued)

(52) U.S. Cl.
CPC ..... *E05B 59/00* (2013.01); *E05B 15/02* (2013.01); *E05B 63/0069* (2013.01);
(Continued)

(58) Field of Classification Search
CPC .. E05B 15/02; E05B 2047/0069; E05B 59/00; E05B 63/0056; E05B 63/0069; E05B 63/14; E05B 65/1086
See application file for complete search history.

(56) References Cited

U.S. PATENT DOCUMENTS 3,390,558 A * 7/1968 Hegedus ..... E05B 59/00 70/107
5,077,992 A * 1/1992 Su ..... E05B 59/00 292/36

(Continued)

FOREIGN PATENT DOCUMENTS

TW 553273 U 9/2003

OTHER PUBLICATIONS

International Search Report and Written Opinion, PCT/US2017/012738, dated Mar. 10, 2017.

(Continued)

*Primary Examiner* — Christopher J Boswell
(74) *Attorney, Agent, or Firm* — Faegre Drinker Biddle & Reath LLP

(57) ABSTRACT

An interconnection assembly includes a chassis, and cam plates that are rotatably coupled to the chassis to pivot about a plurality of rotational axises. An upper cam plate is operatively coupled to a deadbolt. The upper cam plate has a cam surface. A lower cam plate is rotatably coupled to the chassis to pivot about a second rotational axis. The lower cam plate is operatively coupled to an interior latch bolt handle. The lower cam plate has a cam slot. A linkage bar is rotatably coupled to the chassis to pivot about a pivot axis. The linkage bar has a first linkage portion having a first cam follower configured to operatively engage the cam surface of (Continued)

the upper cam plate and has a second linkage portion having a second cam follower operatively received in the cam slot of the lower cam plate.

22 Claims, 10 Drawing Sheets

(51) Int. Cl.

| | |
|---|---|
| ***E05B 63/00*** | (2006.01) |
| ***E05B 65/10*** | (2006.01) |
| ***E05B 63/14*** | (2006.01) |
| *E05B 47/00* | (2006.01) |

(52) U.S. Cl.
CPC ..... *E05B 63/14* (2013.01); *E05B 65/1086* (2013.01); *E05B 63/0056* (2013.01); *E05B 2047/0069* (2013.01)

(56) References Cited

U.S. PATENT DOCUMENTS

| | | | | |
|---|---|---|---|---|
| 5,655,393 | A * | 8/1997 | Kuo | E05B 59/00 70/107 |
| 5,713,612 | A * | 2/1998 | Kajuch | E05B 59/00 292/36 |
| 5,809,812 | A * | 9/1998 | Gallego | E05B 59/00 292/21 |
| 5,881,586 | A | 3/1999 | Shen | |
| 6,058,746 | A | 5/2000 | Mirshafiee et al. | |
| 6,443,506 | B1 * | 9/2002 | Su | E05B 59/00 292/244 |
| 6,454,322 | B1 * | 9/2002 | Su | E05B 59/00 292/244 |
| 7,364,212 | B1 * | 4/2008 | Fan | E05B 65/1086 292/33 |
| 7,871,112 | B2 | 1/2011 | Kondratuk et al. | |
| 10,526,824 | B2 * | 1/2020 | Farias | E05B 63/0056 |
| 2004/0107747 | A1 | 6/2004 | Chang et al. | |

OTHER PUBLICATIONS

International Preliminary Report on Patentability received for PCT Patent Application No. PCT/US2017/012738, dated Jul. 18, 2019, 10 pages.

* cited by examiner

INTERCONNECTED DOOR LOCK

CROSS-REFERENCE TO RELATED APPLICATIONS

This application is a U.S. National Phase Patent Application based on International Application No. PCT/US2017/012738, filed on Jan. 9, 2017, titled "INTERCONNECTED DOOR LOCK" the entire disclosure which is expressly incorporated by reference herein.

FIELD OF THE INVENTION

The present invention relates to a door lock, and, more particularly, to an interconnected door lock.

BACKGROUND ART

Interconnected door locks have long been available, wherein actuation of an interior operator, e.g., knob or lever, simultaneously retracts both a latch bolt and a deadbolt. Such interconnected door locks may be found in both commercial and residential environments.

One such interconnected door lock is disclosed in US 2004/0107747, wherein engagement between a door lock linkage and a secondary linkage allows the pivotal movement of the inner handle to drive the secondary linkage to pivot so that the primary deadbolt is also driven so that the primary deadbolt is retracted. However, the arrangement disclosed in US 2004/0107747 cannot be easily converted from a left-hand door configuration to a right-hand door configuration, or vice-versa.

What is needed in the art is an interconnected door lock having an interconnection assembly that can be easily converted from a left-hand door configuration to a right-hand door configuration, or vice-versa.

SUMMARY OF INVENTION

The present invention provides an interconnected door lock having an interconnection assembly that can be easily converted from a left-hand door configuration to a right-hand door configuration, or vice-versa.

The invention in one embodiment is directed to an interconnection assembly for a door lock set having a deadbolt assembly with a deadbolt and an interior latch bolt handle operatively coupled to a latch bolt. The interconnection assembly includes a chassis defining a first rotational axis, a second rotational axis, and a pivot axis. An upper cam plate is rotatably coupled to the chassis to pivot about the first rotational axis. The upper cam plate is operatively coupled to the deadbolt. The upper cam plate has a cam surface. A lower cam plate is rotatably coupled to the chassis to pivot about the second rotational axis. The lower cam plate is operatively coupled to the interior latch bolt handle. The lower cam plate has a cam slot. A linkage bar is rotatably coupled to the chassis to pivot about the pivot axis. The linkage bar has a first linkage portion and a second linkage portion that extend in opposite directions orthogonal to the pivot axis. The first linkage portion has a first cam follower configured to operatively engage the cam surface of the upper cam plate and the second linkage portion has a second cam follower operatively received in the cam slot of the lower cam plate.

The invention in another embodiment is directed to an interconnected door lock including a latch bolt assembly having a latch bolt and a deadbolt assembly having a deadbolt. A latch bolt handle set includes an exterior latch bolt operator having an exterior latch bolt handle and an interior latch bolt operator having an interior latch bolt handle. Each of the interior latch bolt operator and the exterior latch bolt operator is operatively coupled to the latch bolt assembly to selectively operate the latch bolt. A deadbolt operator set includes an exterior deadbolt operator and an interior deadbolt operator. Each of the exterior deadbolt operator and the interior deadbolt operator is operatively coupled to the deadbolt assembly to selectively operate the deadbolt. An interconnection assembly is configured to interconnect the interior latch bolt handle to the deadbolt operator set. The interconnection assembly includes a chassis defining a first rotational axis, a second rotational axis, and a pivot axis. An upper cam plate is rotatably coupled to the chassis to pivot about the first rotational axis. The upper cam plate is operatively coupled to the deadbolt. The upper cam plate has a cam surface. A lower cam plate is rotatably coupled to the chassis to pivot about the second rotational axis. The lower cam plate is operatively coupled to the interior latch bolt handle. The lower cam plate has an arcuate cam slot. A linkage bar is rotatably coupled to the chassis to pivot about the pivot axis. The linkage bar has a first linkage portion and a second linkage portion that extend in opposite directions orthogonal to the pivot axis. The first linkage portion has a first cam follower configured to operatively engage the cam surface of the upper cam plate and the second linkage portion has a second cam follower operatively received in the arcuate cam slot of the lower cam plate.

Advantageously, conversion of the interconnected door lock from right-hand to left-hand operation, or vice-versa, is a matter of simply changing the direction that each of the deadbolt of the deadbolt assembly and the latch bolt of the latch bolt assembly extends from the chassis, e.g., is effected by rotating each of the deadbolt assembly and the latch bolt assembly by generally 180 degrees.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

For definitional purposes and as used herein "connected" or "attached" includes physical, whether direct or indirect, affixed or adjustably mounted, as for example, an upper cam plate is operatively connected to a deadbolt. Thus, unless specified, "connected" or "attached" is intended to embrace any operationally functional connection.

As used herein "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to accompanying drawings which are provided for illustration purposes as representative of specific exemplary embodiments in which the invention may be practiced. Given the following description of the specification and drawings, the apparatus and methods should become evident to a person of ordinary skill in the art. Further areas of applicability of the present teachings will become apparent from the description provided herein. It is to be understood that other embodiments can be utilized and that structural changes based on presently known structural and/or functional equivalents can be made without departing from the scope of the invention.

BRIEF DESCRIPTION OF DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DESCRIPTION OF EMBODIMENTS

Figure 2:
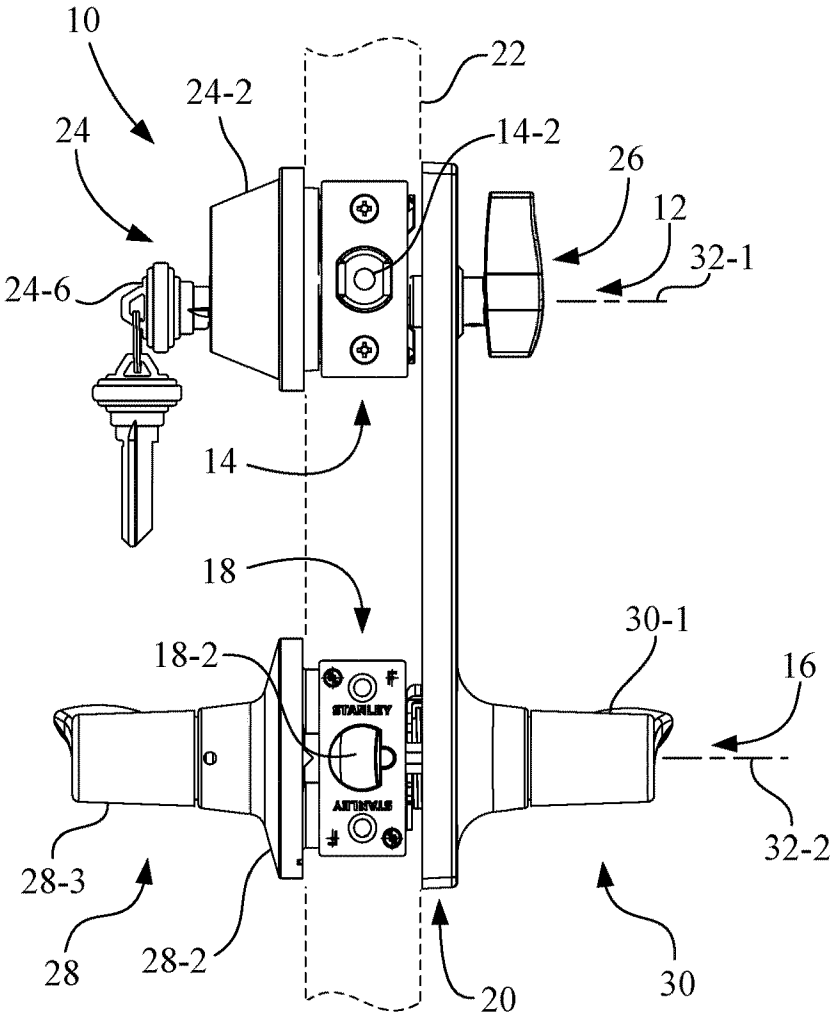
FIG. 2 is a side view of the interconnected door lock of FIG. 1, with a door shown by phantom lines.
Figure 1:
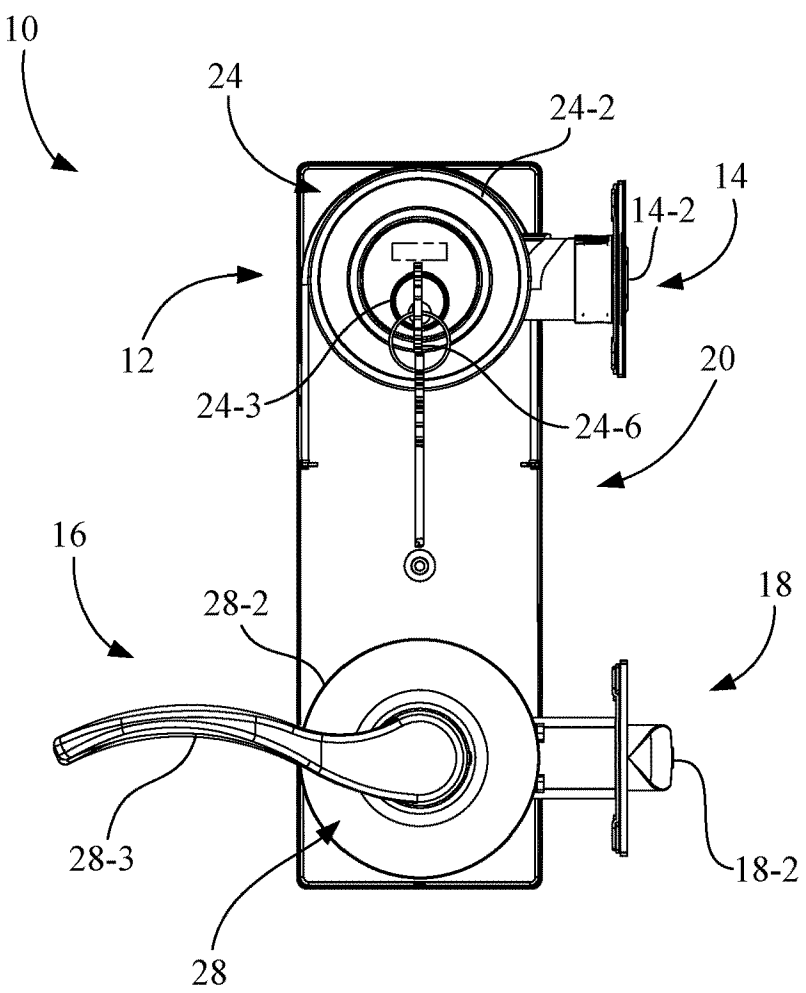
FIG. 1 is a front exterior view of an interconnected door lock in accordance with an aspect of the preset invention, as viewed from the side of the exterior operators.
Figure 3:
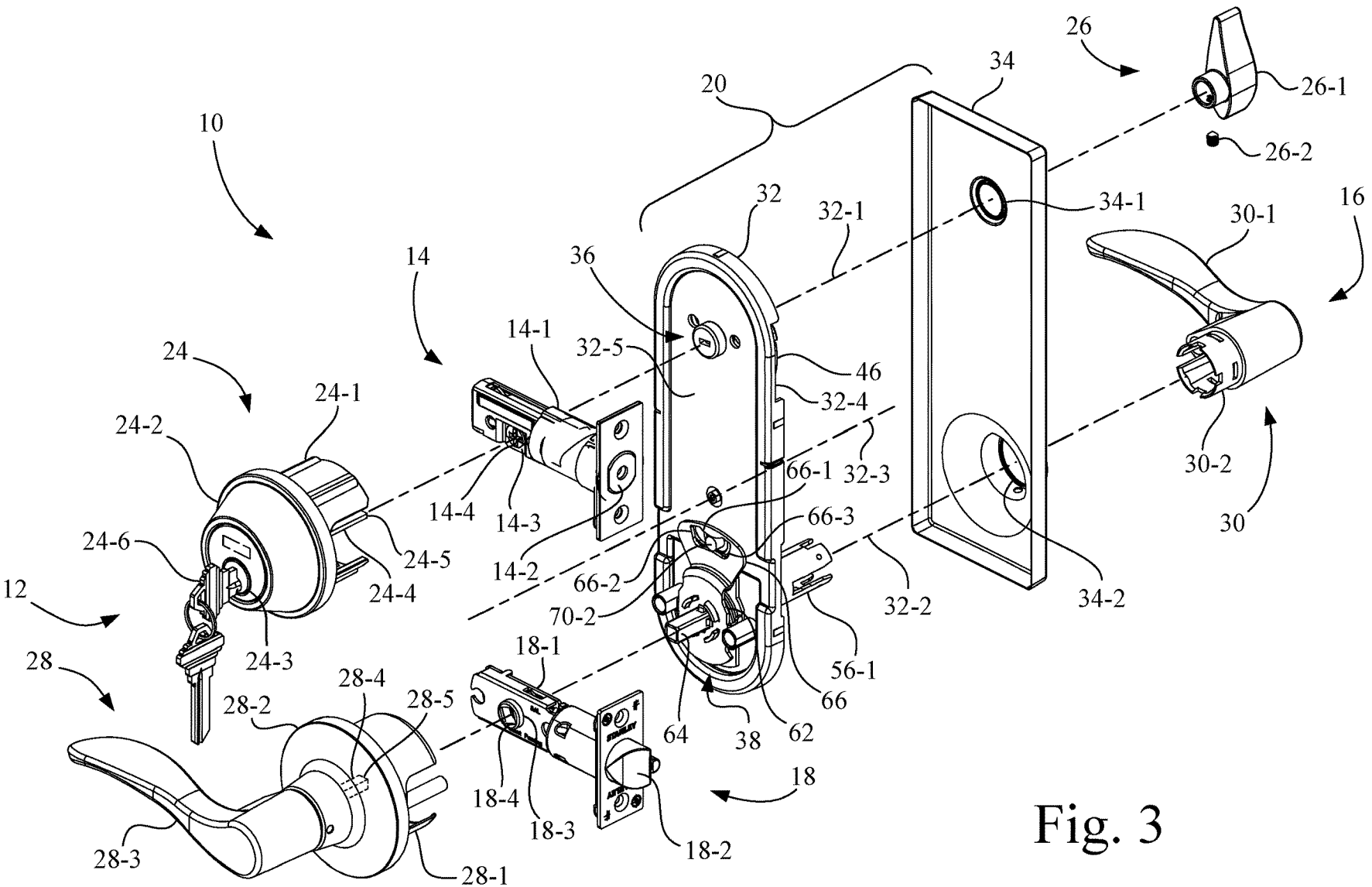
FIG. 3 is an exploded view of the interconnected door lock of FIGS. 1 and 2.

Referring now to the drawings and particularly to FIGS. 1-3, there is shown an interconnected door lock 10 embodying the present invention. Interconnected door lock 10 includes a deadbolt operator set 12, a deadbolt assembly 14, a latch bolt handle set 16, a latch bolt assembly 18, and an interconnection assembly 20. FIG. 2 shows interconnected door lock 10 mounted to a door 22, shown by phantom lines.

Deadbolt operator set 12 includes an exterior deadbolt operator 24 and an interior deadbolt operator 26.

Exterior deadbolt operator 24 includes a mounting chassis 24-1, an exterior escutcheon 24-2, a deadbolt lock cylinder 24-3, and a deadbolt spindle 24-4. Deadbolt spindle 24-4 has a distal end portion 24-5. Deadbolt lock cylinder 24-3 is rotatably coupled to mounting chassis 24-1. Deadbolt lock cylinder 24-3 is operatively connected to deadbolt spindle 24-4, such that a rotation of deadbolt lock cylinder 24-3 via a key 24-6 results in a corresponding rotation of deadbolt spindle 24-4.

Interior deadbolt operator 26 includes an interior deadbolt handle 26-1 and a set screw 26-2 to connect interior deadbolt handle 26-1 to a deadbolt spindle drive of interconnection assembly 20, which in turn is coupled to distal end portion 24-5 of deadbolt spindle 24-4. Accordingly, a rotation of interior deadbolt operator 26 results in a corresponding rotation of deadbolt spindle 24-4. Interior deadbolt handle 26-1 may be, for example, a turn lever or knob, but is not limited in this regard.

Deadbolt assembly 14 includes a housing 14-1, a deadbolt 14-2, and a deadbolt drive 14-3. Deadbolt 14-2 is slidably received in housing 14-1, and is movable between an extended position and a retracted position. Each of exterior deadbolt operator 24 and interior deadbolt operator 26 is operatively coupled to deadbolt assembly 14 to selectively operate deadbolt 14-2. Deadbolt drive 14-3 is rotatable relative to housing 14-1, and is operatively coupled to deadbolt 14-2. Deadbolt drive 14-3 is configured to convert a rotary input into a linear translation of latch bolt 14-2. Deadbolt drive 14-3 includes a drive opening 14-4 for drivably receiving deadbolt spindle 24-4, such that the rotary input may be provided by either of deadbolt lock cylinder 24-3 or interior deadbolt handle 26-1 of deadbolt operator set 12.

Latch bolt handle set 16 includes an exterior latch bolt operator 28 and an interior latch bolt operator 30. Exterior latch bolt operator 28 includes a mounting chassis 28-1, an exterior escutcheon 28-2, an exterior latch bolt handle 28-3, and a latch bolt spindle drive 28-4 (shown in dashed lines). Latch bolt spindle drive 28-4 has a distal end portion 28-5. Exterior latch bolt handle 28-3 is rotatably coupled to mounting chassis 28-1. Exterior latch bolt handle 28-3 is operatively connected to latch bolt spindle drive 28-4, such that a rotation of exterior latch bolt handle 28-3 results in a corresponding rotation of latch bolt spindle drive 28-4.

Exterior latch bolt handle 28-3 may be, for example, a turn lever or knob but is not limited in this regard.

Interior latch bolt operator 30 includes an interior latch bolt handle 30-1 having a tubular coupler 30-2 that is coupled to interconnection assembly 20. Interior latch bolt handle 30-1 may be, for example, a turn lever or knob.

Latch bolt assembly 18 includes a housing 18-1, a latch bolt 18-2, and a latch bolt drive 18-3. Each of exterior latch bolt operator 28 and interior latch bolt operator 30 is operatively coupled to latch bolt assembly 18 to selectively operate latch bolt 18-2. Latch bolt 18-2 is slidably received in housing 18-1, and is movable between an extended position and a retracted position. Latch bolt drive 18-3 is rotatable relative to housing 18-1, and is operatively coupled to latch bolt 18-2. Latch bolt drive 18-3 is configured to convert a rotary input into a linear translation of latch bolt 18-2. Latch bolt drive 18-3 includes a drive opening 18-4 for drivably receiving latch bolt spindle drive 28-4, such that the rotary input may be provided by exterior latch bolt handle 28-3. Also, drive opening 18-4 of latch bolt drive 18-3 drivably receives a spindle of interconnection assembly 20, as more fully described below, which in turn drivably couples interior latch bolt handle 30-1 to latch bolt drive 18-3, such that interior latch bolt handle 30-1 may provide the rotary input to latch bolt drive 18-3.

Interconnection assembly 20 is configured to interconnect interior latch bolt handle 30-1 of latch bolt handle set 16 to deadbolt operator set 12, so as to facilitate operation of deadbolt 14-2 via operation of interior latch bolt handle 30-1.

Figure 4:
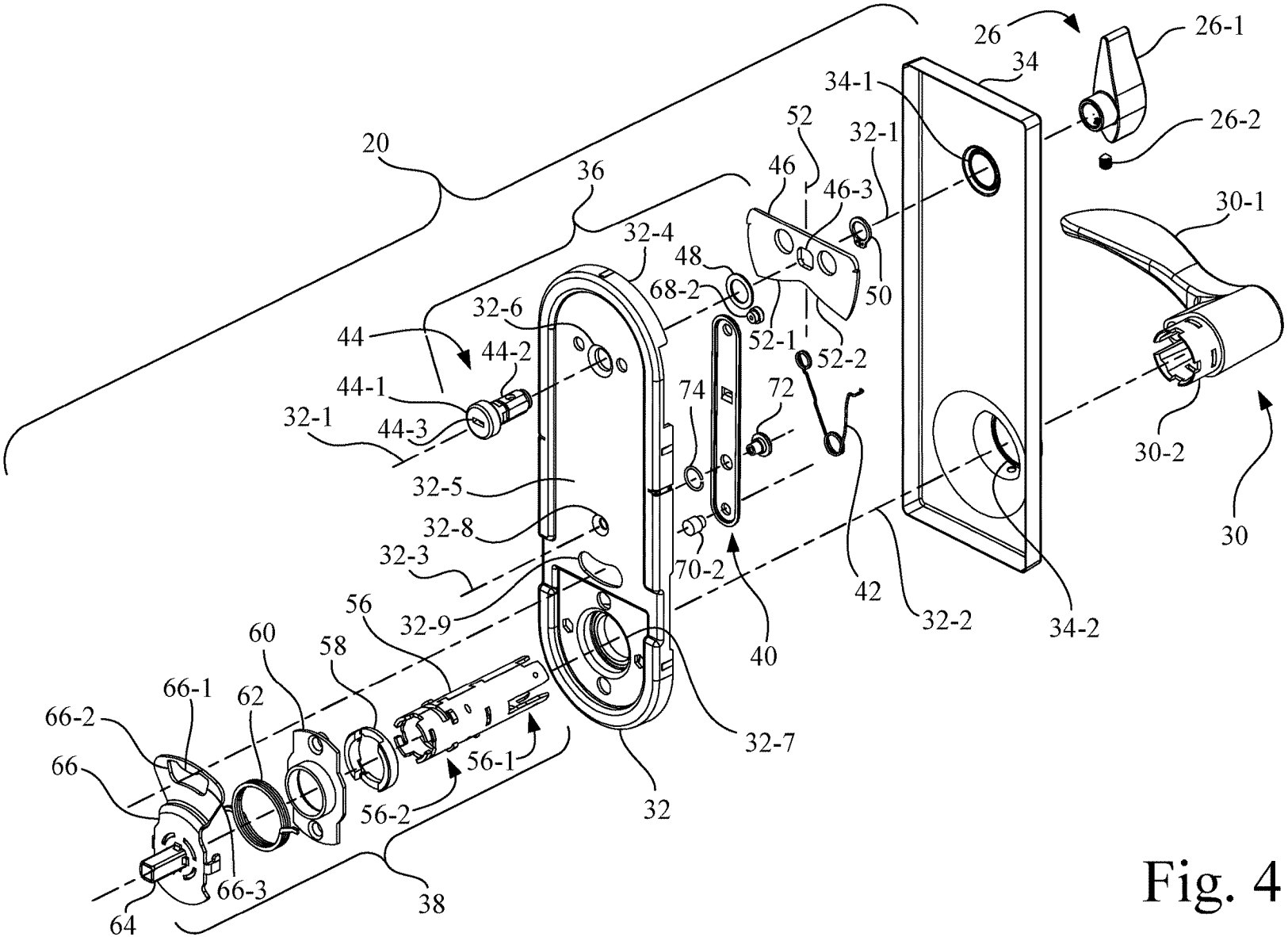
FIG. 4 is an exploded view of the interconnection assembly of the interconnected door lock of FIGS. 1-3

Referring also to FIG. 4, interconnection assembly 20 includes a chassis 32, an interior escutcheon 34, a deadbolt spindle drive assembly 36, a tubular latch bolt drive assembly 38, a linkage bar 40, and a return spring 42.

Chassis 32 defines a first rotational axis 32-1, a second rotational axis 32-2, and a pivot axis 32-3. Deadbolt spindle drive assembly 36 is rotatably coupled to chassis 32 to pivot about first rotational axis 32-1. Tubular latch bolt drive assembly 38 is rotatably coupled to chassis 32 to pivot about second rotational axis 32-2. Linkage bar 40 is rotatably coupled to chassis 32 to pivot about pivot axis 32-3. Also, deadbolt operator set 12 is configured to rotate about first rotational axis 32-1 and latch bolt handle set 16 is configured to rotate about second rotational axis 32-2.

Chassis 32 is in the form of an elongate plate having a first side 32-4 and a second side 32-5. Chassis 32 has a first hole 32-6, a second hole 32-7, a third hole 32-8 and an arcuate opening 32-9. First hole 32-6 is centered on first rotational axis 32-1, second hole 32-7 is centered on second rotational axis 32-2, and third hole 32-8 is centered on pivot axis 32-3. Arcuate opening 32-9 is radially positioned between second hole 32-7 and third hole 32-8. Each of first hole 32-6, second hole 32-7, third hole 32-8, and arcuate opening 32-9 extends axially through chassis from first side 32-4 to second side 32-5.

Interior escutcheon 34 is configured to cover the internal components of interconnection assembly 20, and is configured for removable mounting (e.g., via snap fit, slidable attachment, or screws) to chassis 32. Interior escutcheon 34 includes an opening 34-1 and an opening 34-2. Opening 34-1 is centered on first rotational axis 32-1 and opening 34-2 is centered on second rotational axis 32-2.

Deadbolt spindle drive assembly 36 includes a spindle drive 44, an upper cam plate 46, a washer 48 and a retainer 50. Spindle drive 44 is sized to be rotatably received in first hole 32-6 of chassis 32. Spindle drive 44 has an enlarged head 44-1, a shaft portion 44-2, and a drive opening 44-3. Shaft portion 44-2 extends axially through first hole 32-6, and enlarged head 44-1 prevents spindle drive 44 from passing in its entirety through first hole 32-6 of chassis 32. Shaft portion 44-2 has a noncircular exterior shape, e.g., rectangular, to drivably receive upper cam plate 46 but is not limited in this regard and can be any shape configured for operating the spindle drive 44. Drive opening 44-3 is centrally located in spindle drive 44 for alignment with first rotational axis 32-1. Drive opening 44-3 of spindle drive 44 is sized and shaped to drivably receive distal end portion 24-5 of deadbolt spindle 24-4, such that a rotation of spindle drive 44 results in a corresponding translation movement of deadbolt 14-2.

Figure 5:
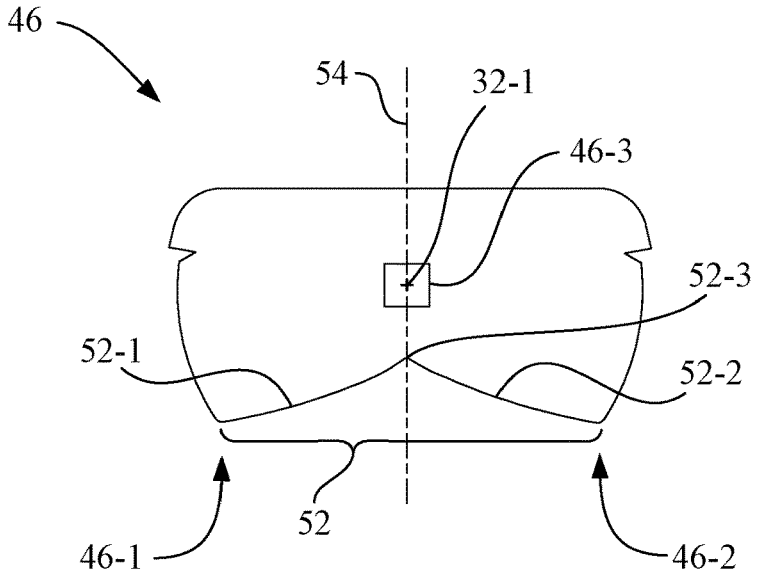
FIG. 5 is an enlarged view of the upper cam plate of the interconnection assembly depicted in FIGS. 3 and 4.

Referring also to FIG. 5, upper cam plate 46 has first wing portion 46-1, a second wing portion 46-2, and a mounting hole 46-3. Mounting hole 46-3 has a noncircular shape, e.g., rectangular, such that shaft portion 44-2 of spindle drive 44 is drivably received through mounting hole 46-3. Upper cam plate 46 is rotatably coupled to chassis 32 to pivot about first rotational axis 32-1 via spindle drive 44.

Upper cam plate 46 further includes a cam surface 52. First wing portion 46-1 is symmetrical to second wing portion 46-2 with respect to a vertical centerline 54 of upper cam plate 46 to define cam surface 52 as having a downwardly facing V-shape. The V-shaped cam surface 52 defines a first cam surface portion 52-1 and a second cam surface portion 52-2. An apex 52-3 of the V-shape is located on vertical centerline 54. The apex 52-3 joins first cam surface portion 52-1 with second cam surface portion 52-2. In the present embodiment, first cam surface portion 52-1 diverges from second cam surface portion 52-2 at the apex 52-3 in an angular range between first cam surface portion 52-1 and second cam surface portion 52-2, for example, of generally 140 to 160 degrees.

Deadbolt spindle drive assembly 36 is assembled on chassis 32 as follows. Shaft portion 44-2 of spindle drive 44 is inserted through first hole 32-6 in a direction from second side 32-5 to first side 32-4 until enlarged head 44-1 engages second side 32-5 of chassis 32. Washer 48 is then installed over shaft portion 44-2 on first side 32-4 of chassis 32. Upper cam plate 46 is then mounted to spindle drive 44 by inserting shaft portion 44-2 through mounting hole 46-3 of upper cam plate 46, and the assembly is completed by connecting retainer 50, e.g., a snap ring, near the free end of shaft portion 44-2 of spindle drive 44. Drive opening 44-3 of spindle drive 44 is sized and shaped to drivably receive distal end portion 24-5 of deadbolt spindle 24-4, such that a rotation of spindle drive 44 results in a corresponding rotation of deadbolt drive 14-3, and in turn, a corresponding translation movement of deadbolt 14-2.

Stated differently, upper cam plate 46 is operatively coupled to deadbolt 14-2, wherein as configured, any rotation of spindle drive 44 of deadbolt spindle drive assembly 36 to operate deadbolt assembly 14 results in a corresponding rotation of upper cam plate 46. Conversely, upper cam plate 46 is operatively coupled to linkage bar 40 via cam surface 52, such that any rotation of upper cam plate 46 when acted upon by linkage bar 40 will result in a corresponding rotation of deadbolt drive 14-3 and in turn, a corresponding translation movement of deadbolt 14-2.

Referring again to FIG. 4, tubular latch bolt drive assembly 38 includes a drive tube 56, a mounting ring 58, a mounting bracket 60, a return spring 62, a drive spindle 64, and a lower cam plate 66.

Drive tube 56 includes a first end portion 56-1 and a second end portion 56-2. Mounting ring 58 is connected to a central portion of drive tube 56. First end portion 56-1 of drive tube 56 projects through second hole 32-7 of chassis 32. Mounting ring 58 is positioned between mounting bracket 60 and chassis 32, with mounting bracket 60 being connected to chassis 32 via fasteners, e.g., screws or bolts. First end portion 56-1 of drive tube 56 is configured to connect to tubular coupler 30-2 of interior latch bolt operator 30.

Second end portion 56-2 of drive tube 56 is configured to connect to lower cam plate 66 via an annular series of tabs that engage corresponding slots in 006Cower cam plate 66. Drive spindle 64 is connected to lower cam plate 66 for rotation about second rotational axis 32-2. As best shown in FIG. 3, drive spindle 64 is sized and shaped, e.g., as a rectangular drive, to be drivably received in drive opening 18-4 of latch bolt drive 18-3 of latch bolt assembly 18. As configured, any rotation of drive spindle 64 results in a corresponding rotation of latch bolt drive 18-3 of latch bolt assembly 18 and of lower cam plate 66.

Referring again to FIGS. 3 and 4, return spring 62, e.g., a torsion spring, engages lower cam plate 66 and chassis 32, so as to return lower cam plate 66, and in turn interior latch bolt operator 30, to a home position when no external force is exerted on interior latch bolt handle 30-1. As configured, a rotation of interior latch bolt handle 30-1 of interior latch bolt operator 30 results in a corresponding rotation of lower cam plate 66 and drive spindle 64 of tubular latch bolt drive assembly 38, so as to effect a corresponding rotation of latch bolt drive 18-3 of latch bolt assembly 18, and in turn, a corresponding translation of latch bolt 18-2.

As assembled, lower cam plate 66 is rotatably coupled to chassis 32 to pivot about second rotational axis 32-2, with lower cam plate 66 being operatively coupled to interior latch bolt handle 30-1. Lower cam plate 66 has an arcuate cam slot 66-1 having an upwardly facing U-shape. Arcuate cam slot 66-1 defines an arcuate path, with arcuate cam slot 66-1 having a first terminal end 66-2 and a second terminal end 66-3 that is spaced apart from first terminal end 66-2 along the arcuate path. Lower cam plate 66 is operatively coupled to linkage bar 40 via arcuate cam slot 66-1.

Figure 6:
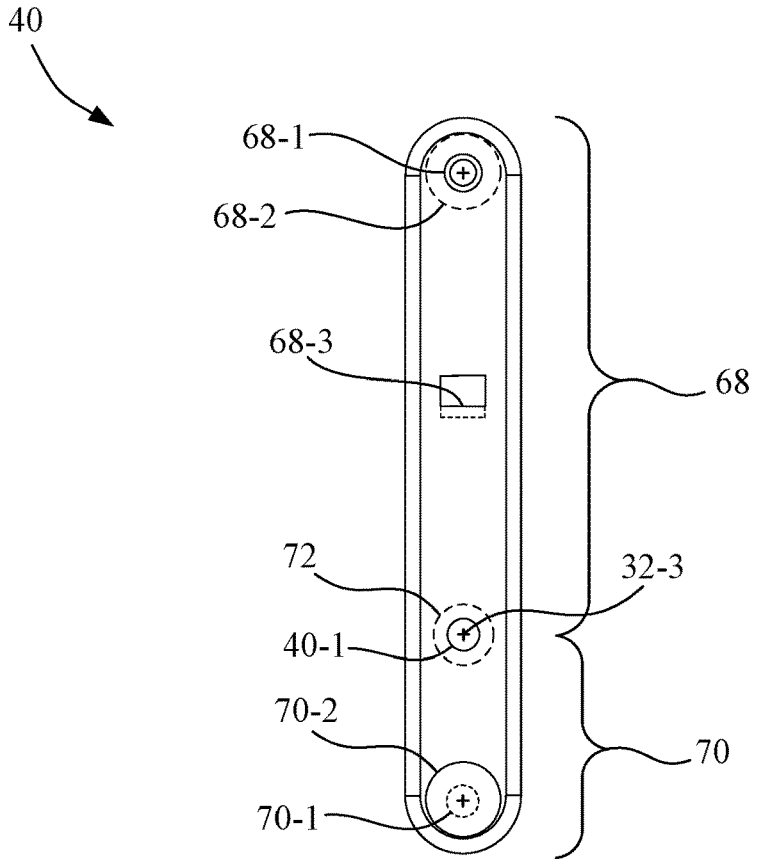
FIG. 6 is an enlarged view of the linkage bar of the interconnection assembly depicted in FIGS. 3 and 4.

Linkage bar 40 is rotatably coupled to chassis 32 to pivot about pivot axis 32-3, and is located on first side 32-4 of chassis 32, along with lower cam plate 66. Referring also to FIG. 6, linkage bar 40 is in the form of an elongate member having a pivot hole 40-1, a first linkage portion 68, a second linkage portion 70. Pivot hole 40-1 is axially aligned with pivot axis 32-3. First linkage portion 68 and second linkage portion 70 extend in opposite directions orthogonal to pivot axis 32-3.

First linkage portion 68 includes an upper hole 68-1 for mounting an upper cam follower 68-2, e.g., by press fit, rivet, or threaded fastener, and has a spring mounting tab 68-3 for receiving an eye-portion of return spring 42. Second linkage portion 70 has a lower hole 70-1 for mounting a lower cam follower 70-2, e.g., by press fit, rivet, or threaded fastener. Each of upper cam follower 68-2 and lower cam follower 70-2 may be in the form of a pin that projects from a surface of linkage bar 40 in a direction substantially parallel to pivot axis 32-3. Alternatively, it is contemplated that one or both of upper cam follower 68-2 and lower cam follower 70-2 may be in the form of a roller.

Linkage bar 40 further includes a pivot pin 72 that extends through pivot hole 40-1 to connect, e.g., by press fit, rivet, or threaded fastener, to third hole 32-8 of chassis 32 on pivot axis 32-3, with a spacing washer 74 positioned between linkage bar 40 and chassis 32. As such, linkage bar 40 is configured to pivot about pivot axis 32-3.

Referring to FIGS. 4-6, upper cam follower 68-2 of first linkage portion 68 of linkage bar 40 is configured to operatively engage cam surface 52 of upper cam plate 46. Since upper cam plate 46 and lower cam plate 66 are mounted on opposite sides of chassis 32, lower cam follower 70-2 of second linkage portion 70 of linkage bar 40 is received through arcuate opening 32-9 in chassis 32 (see FIG. 4) so as to be operatively received in arcuate cam slot 66-1 of lower cam plate 66 (see also FIG. 3).

Upper cam follower 68-2 of first linkage portion 68 of linkage bar 40 is configured to follow at least a portion of the V-shape of cam surface 52 as upper cam plate 46 pivots about first rotational axis 32-1, such that linkage bar 40 pivots about pivot axis 32-3 to reposition lower cam follower 70-2 of second linkage portion 70 of linkage bar 40 in arcuate cam slot 66-1 of lower cam plate 66.

Figure 7A:
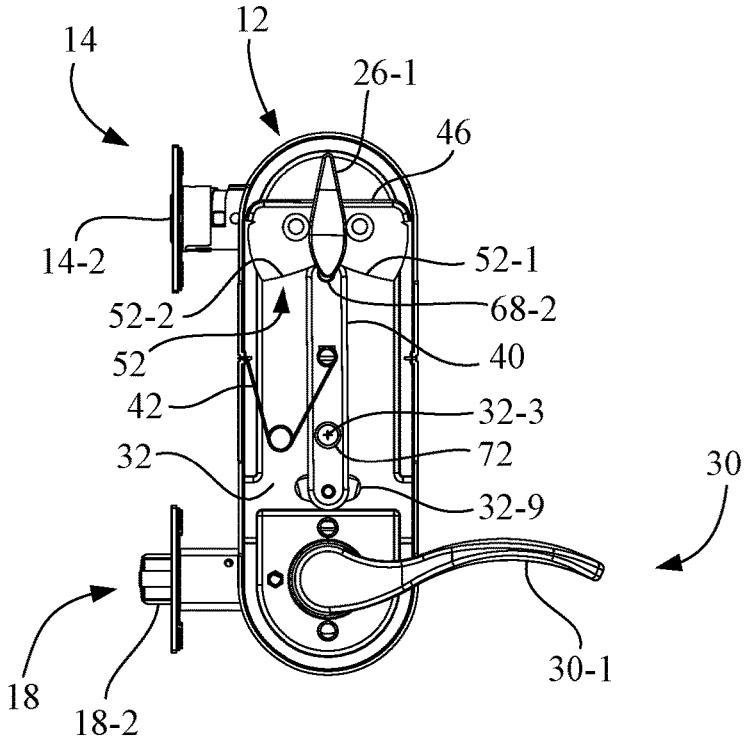
FIG. 7A is a front interior view of the interconnected door lock of FIGS. 1-4, with the interior escutcheon removed, showing the deadbolt in a retracted position and the latch bolt in the extended position.
Figure 7B:
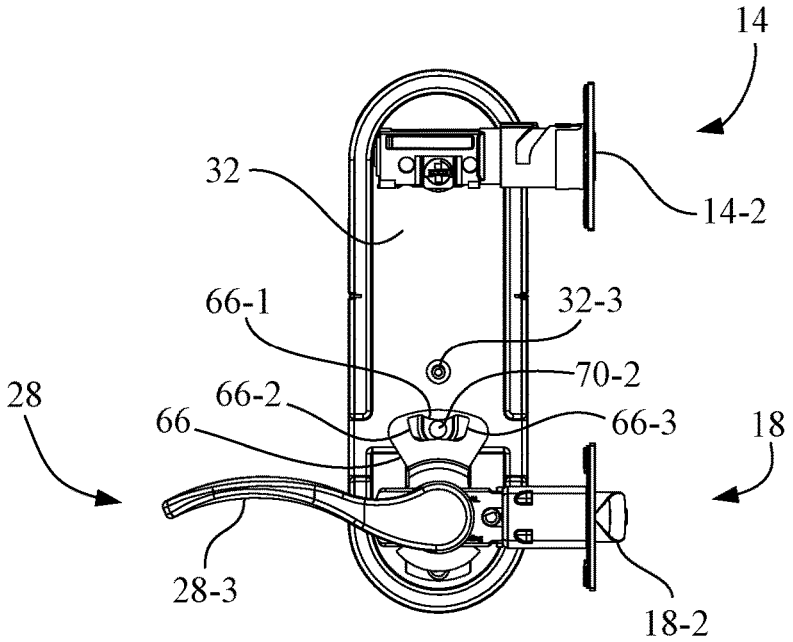
FIG. 7B is a rear view of the interconnected door lock of FIG. 7A.
Figure 8A:
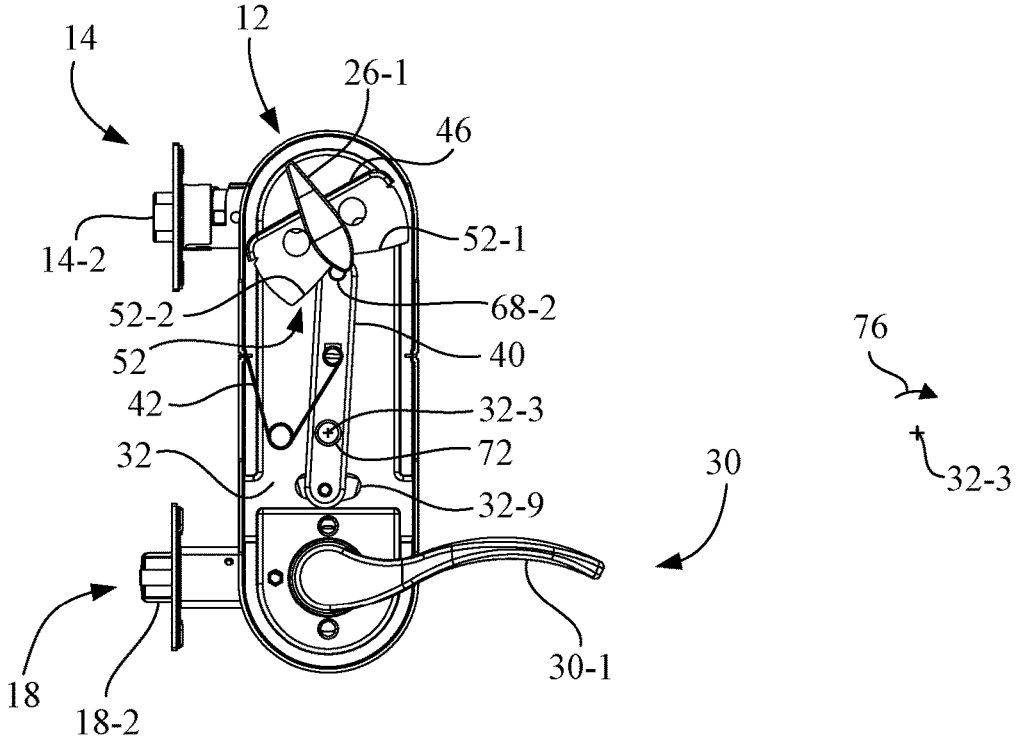
FIG. 8A is a front interior view of the interconnected door lock of FIGS. 1-4, with the interior escutcheon removed, showing the deadbolt in a partially extended position as a result of a rotation of the interior deadbolt handle.
Figure 8B:
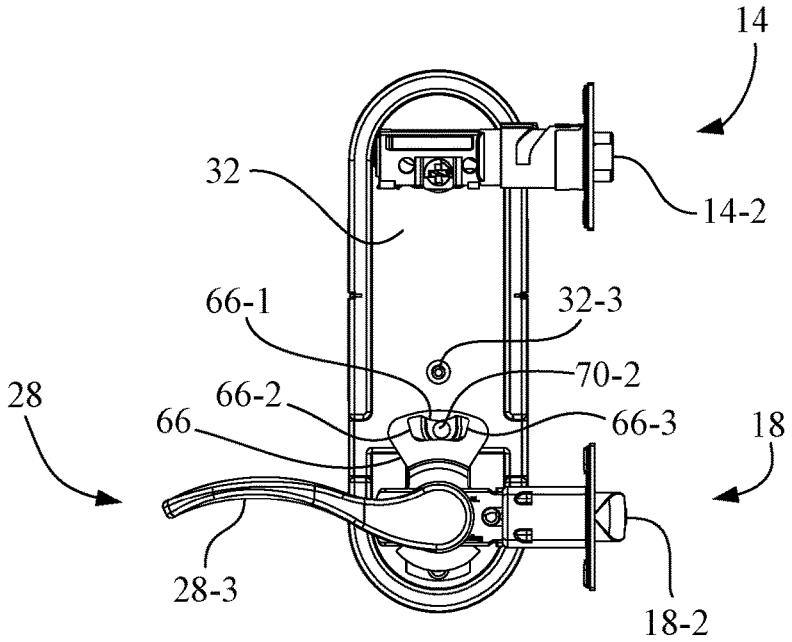
FIG. 8B is a rear view of the interconnected door lock of FIG. 8A.

FIGS. 7A and 7B depicted an unlocked state of interconnected door lock 10, wherein deadbolt 14-2 is in a retracted position and latch bolt 18-2 is in the normal extended position. When deadbolt 14-2 is in the retracted position, upper cam follower 68-2 of first linkage portion 68 of linkage bar 40 is positioned at the central apex 52-3 of cam surface 52 of upper cam plate 46, and lower cam follower 70-2 of second linkage portion 70 of linkage bar 40 is positioned at a central portion of arcuate cam slot 66-1 of lower cam plate 66.

Figure 9A:
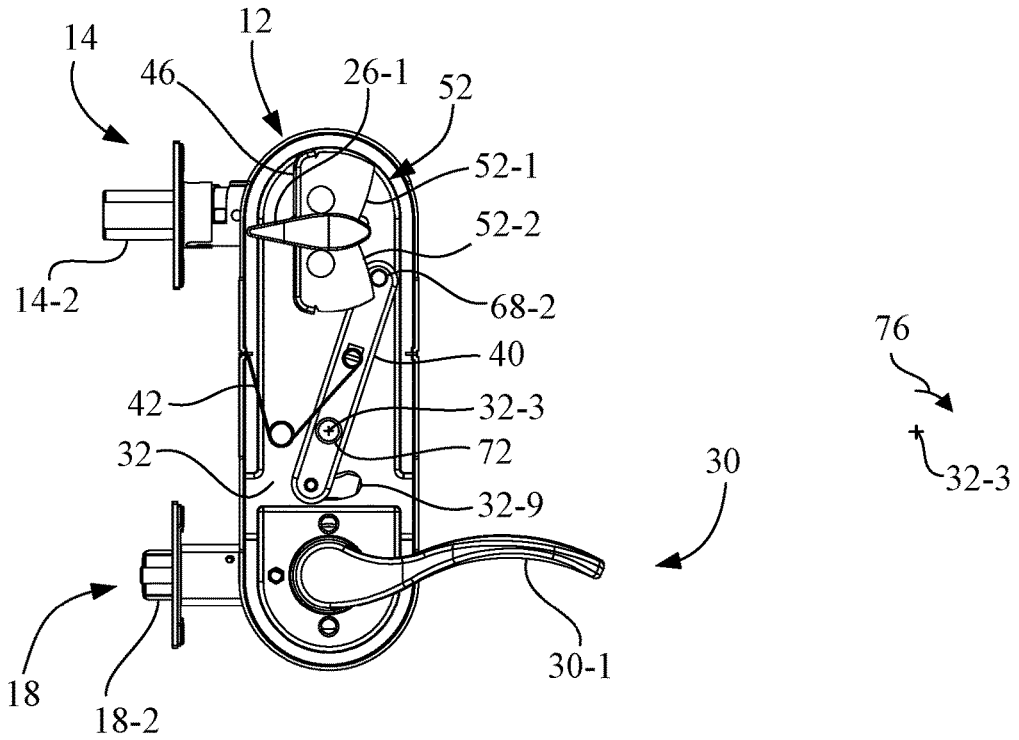
FIG. 9A is a front interior view of the interconnected door lock of FIGS. 1-4, with the interior escutcheon removed, showing the deadbolt in a fully extended position as a result of a further rotation of the interior deadbolt handle.
Figure 9B:
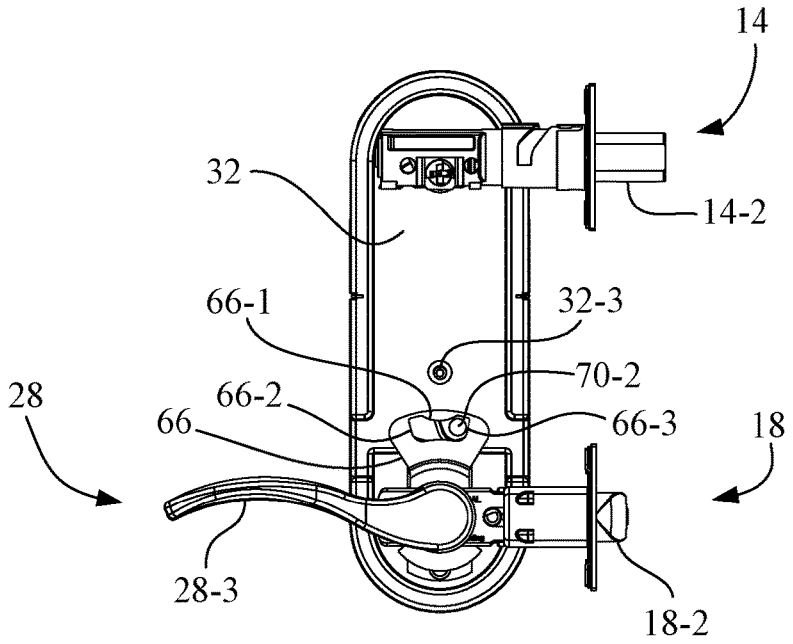
FIG. 9B is a rear view of the interconnected door lock of FIG. 9A.
Figure 10A:
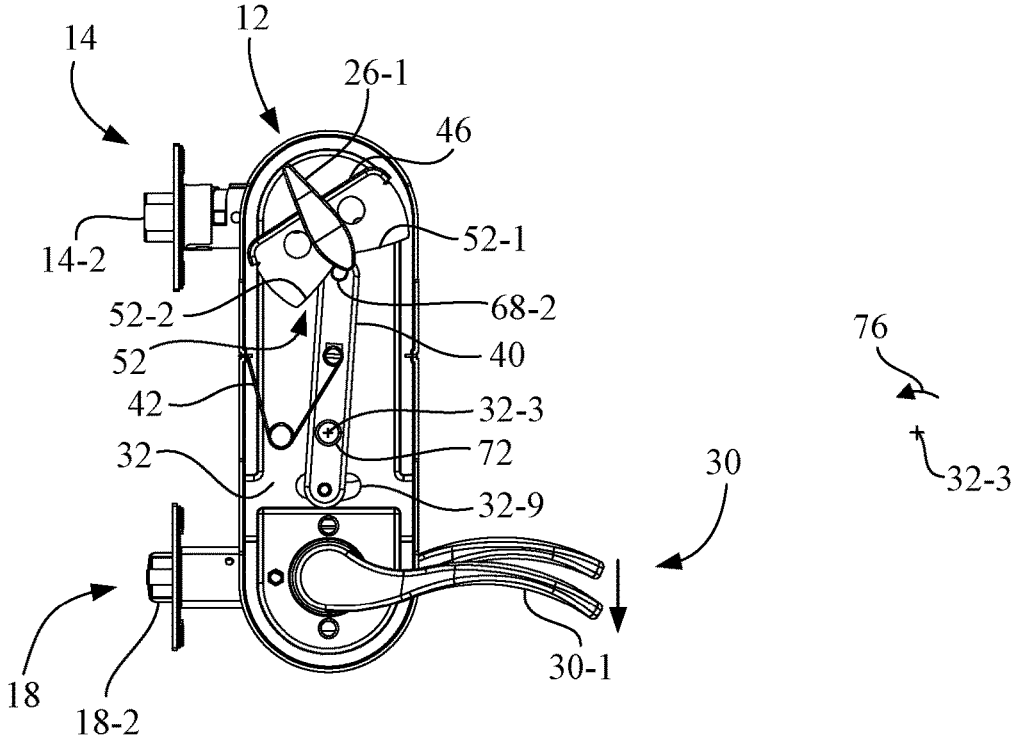
FIG. 10A is a front interior view of the interconnected door lock of FIGS. 1-4, with the interior escutcheon removed, showing the deadbolt and the latch bolt in a partially retracted position as a result of a rotation of the interior latch bolt handle.
Figure 10B:
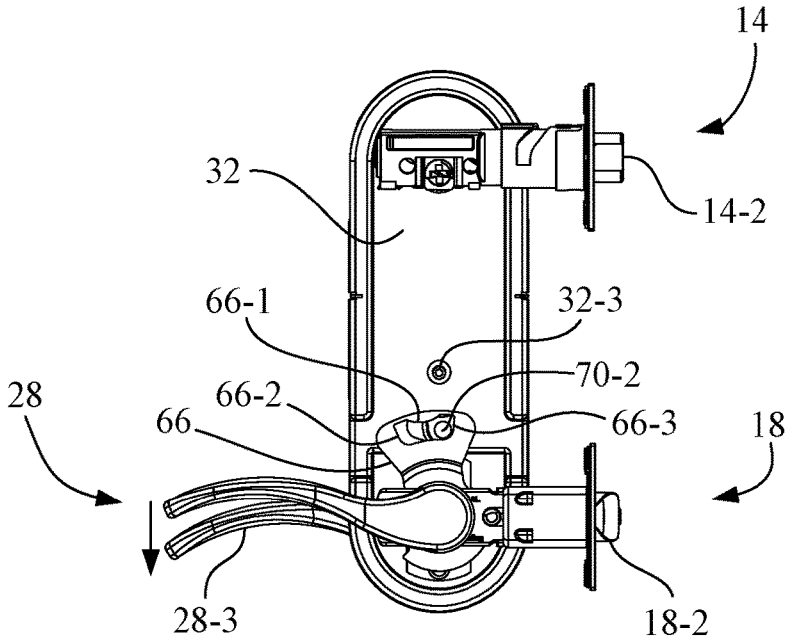
FIG. 10B is a rear view of the interconnected door lock of FIG. 10A.
Figure 11A:
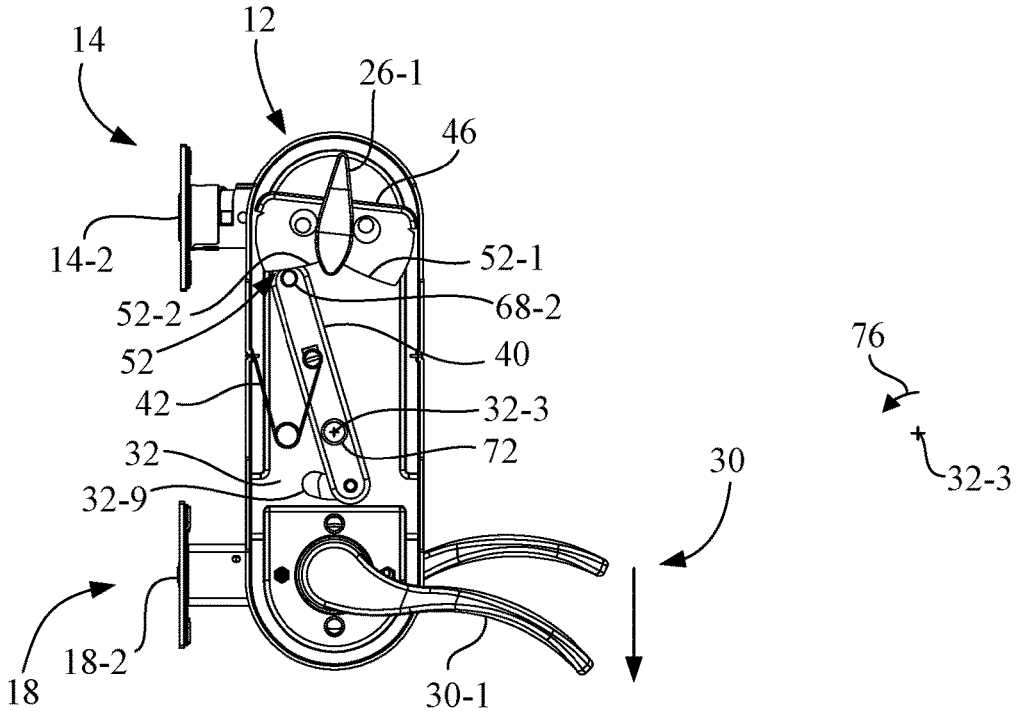
FIG. 11A is a front interior view of the interconnected door lock of FIGS. 1-4, with the interior escutcheon removed, showing the deadbolt and the latch bolt in a fully retracted position as a result of a further rotation of the interior latch bolt handle.
Figure 11B:
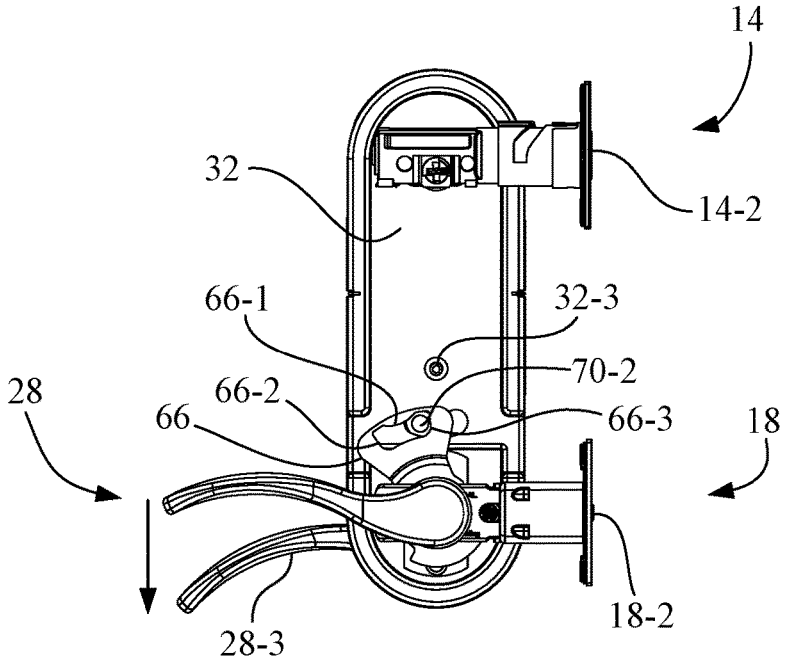
FIG. 11B is a rear view of the interconnected door lock of FIG. 11A.

FIGS. 8A, 8B, 9A and 9B depict a component progression wherein deadbolt 14-2 is extended to the locked position by rotation of interior deadbolt handle 26-1 of interior deadbolt operator 26. An arrow 76 indicates the direction of rotation of linkage bar 40 about pivot axis 32-3 for the associated drawing. In the progression of the extension of deadbolt 14-2 to the extended position, upper cam follower 68-2 of first linkage portion 68 of linkage bar 40 is moved by cam surface 52 of upper cam plate 46 away from the central apex 52-3 to one of first cam surface portion 52-1 and second cam surface portion 52-2, and lower cam follower 70-2 of second linkage portion 70 of linkage bar 40 is positioned at a corresponding one of first terminal end 66-2 and second terminal end 66-3 of the arcuate cam slot 66-1 of lower cam plate 66, depending on whether interconnected door lock 10 is configured for right-handed door operation or left-handed door operation. In the particular configuration as shown in FIGS. 9A and 9B, upper cam follower 68-2 of first linkage portion 68 of linkage bar 40 is moved by cam surface 52 of upper cam plate 46 away from the central apex 52-3 to second cam surface portion 52-2, and lower cam follower 70-2 of second linkage portion 70 of linkage bar 40 is positioned at second terminal end 66-3 of arcuate cam slot 66-1 of lower cam plate 66 (see FIG. 9B).

FIGS. 10A, 10B, 11A, 11B show a progression of the retraction of deadbolt 14-2 in conjunction with a retraction of latch bolt 18-2 from the fully extended positions depicted in FIGS. 9A and 9B via a rotation of interior latch bolt handle 30-1 of interior latch bolt operator 30. Again, in the fully extended positions of FIGS. 9A and 9B, lower cam follower 70-2 of second linkage portion 70 of linkage bar 40 is positioned at second terminal end 66-3 of arcuate cam slot 66-1 of lower cam plate 66. As such, referring to FIGS. 10A, 10B, 11A, and 11B, a downward movement of interior latch bolt handle 30-1 of interior latch bolt operator 30 causes a rotation of interior latch bolt handle 30-1 about second rotational axis 32-2 that results in a corresponding rotation of lower cam plate 66 about second rotational axis 32-2 to rotationally displace arcuate cam slot 66-1 relative to second rotational axis 32-2 as depicted in the progression 10B, 11B, and in turn invokes a counter rotation (see arrow 76; FIGS.

10A, 11A) of linkage bar 40 about pivot axis 32-3 to reposition upper cam follower 68-2 of first linkage portion 68 of linkage bar 40 along second cam surface portion 52-2 of cam surface 52 of upper cam plate 46 as depicted in the progression 10A, 11A, to in turn rotate upper cam plate 46 to effect a retraction of deadbolt 14-2.

Figure 12:
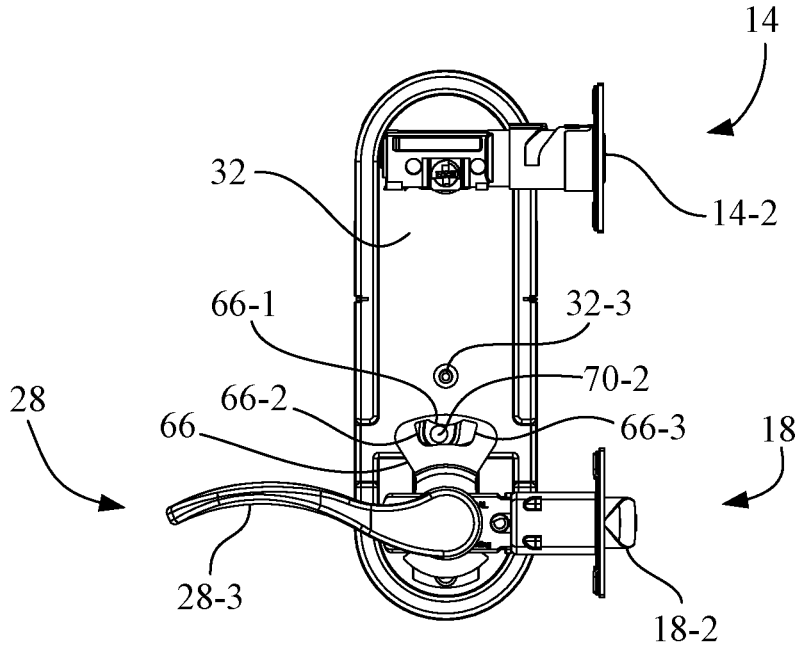
FIG. 12 is a rear view of the interconnected door lock of FIGS. 1-4, wherein the interior latch bolt handle of the interior latch bolt operator is released from rotation to return to the normal released position.

As depicted in FIG. 12, when interior latch bolt handle 30-1 of interior latch bolt operator 30 is released from rotation, return spring 62 (see FIGS. 3 and 4) returns interior latch bolt handle 30-1 to the normal released position.

Advantageously, conversion of interconnected door lock 10 from right-hand to left-hand operation, or vice-versa, is a matter of simply changing the direction that each of deadbolt 14-2 of deadbolt assembly 14 and latch bolt 18-2 of latch bolt assembly 18 extends from chassis 32, e.g., is effected by rotating each of deadbolt assembly 14 and latch bolt assembly 18 by generally 180 degrees relative to chassis 32.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An interconnection assembly for a door lock set having a deadbolt assembly with a deadbolt and an interior latch bolt handle operatively coupled to a latch bolt, the interconnection assembly comprising:

a chassis defining a first rotational axis, a second rotational axis, and a pivot axis, the chassis having a first side and a second side facing in a direction directed away from the first side;

an upper cam plate rotatably coupled to the chassis to pivot about the first rotational axis, the upper cam plate being operatively coupled to the deadbolt, the upper cam plate having a cam surface, the upper cam plate being located entirely on the first side of the chassis;

a lower cam plate rotatably coupled to the chassis to pivot about the second rotational axis, the lower cam plate being operatively coupled to the interior latch bolt handle, the lower cam plate having a cam slot, the lower cam plate being located on the second side of the chassis; and a linkage bar rotatably coupled to the chassis to pivot about the pivot axis, the linkage bar having a first linkage portion and a second linkage portion that extend in opposite directions orthogonal to the pivot axis, the first linkage portion having a first cam follower configured to operatively engage the cam surface of the upper cam plate and the second linkage portion having a second cam follower operatively received in the cam slot of the lower cam plate.

2. The interconnection assembly of claim 1, wherein the chassis is in the form of an elongate plate, the linkage bar is located on the first side of the chassis, and the chassis having an opening through which the second cam follower is received.

3. The interconnection assembly of claim 1, wherein each of the first cam follower and the second cam follower is a pin that projects from a surface of the linkage bar in a direction substantially parallel to the pivot axis.

4. The interconnection assembly of claim 1, wherein the cam surface of the upper cam plate has a downwardly facing V-shape and the cam slot of the lower cam plate has an upwardly facing U-shape.

5. The interconnection assembly of claim 1, wherein the upper cam plate has a first wing portion and a second wing portion, the first wing portion being symmetrical to the second wing portion with respect to a centerline of the upper cam plate to define the cam surface as having a downwardly facing V-shape and with an apex of the V-shape located on the centerline.

6. The interconnection assembly of claim 1, wherein the cam surface of the upper cam plate has a downwardly facing V-shape that defines a first cam surface portion, a second cam surface portion, and an apex that joins the first cam surface portion with the second cam surface portion, wherein the first cam surface portion diverges from the second cam surface portion at the apex in an angular range of 140 to 160 degrees.

7. The interconnection assembly of claim 1, wherein the cam surface of the upper cam plate has a downwardly facing V-shape that defines a first cam surface portion, a second cam surface portion, and a central apex that joins the first cam surface portion with the second cam surface portion, and the cam slot defines a path having a first terminal end and a second terminal end spaced apart from the first terminal end, the first cam follower of the first linkage portion of the linkage bar configured to follow at least a portion of the V-shape of the cam surface as the first cam plate pivots about the first rotational axis, such that the linkage bar pivots about the pivot axis to reposition the second cam follower of the second linkage portion of the linkage bar in the cam slot of the lower cam plate.

8. The interconnection assembly of claim 7, wherein when the deadbolt is in a retracted position, the first cam follower of the first linkage portion of the linkage bar is positioned at the central apex of the cam surface of the upper cam plate, and the second cam follower of the second linkage portion of the linkage bar is positioned at a central portion of the cam slot of the lower cam plate.

9. The interconnection assembly of claim 8, wherein when the deadbolt is in an extended position, the first cam follower of the first linkage portion of the linkage bar is moved by the cam surface of the upper cam plate away from the central apex to one of the first cam surface portion and the second cam surface portion, and the second cam follower of the second linkage portion of the linkage bar is positioned at a corresponding one of the first terminal end and the second terminal end of the cam slot of the lower cam plate.

10. The interconnection assembly of claim 9, wherein with the second cam follower of the second linkage portion of the linkage bar positioned at a corresponding one of the first terminal end and the second terminal end of the cam slot of the lower cam plate, a rotation of the interior latch bolt handle about the second rotational axis results in a corresponding rotation of the lower cam plate about the second rotational axis to rotationally displace the cam slot relative to the second rotational axis and in turn invoke a counter rotation of the linkage bar about the pivot axis to reposition the first cam follower of the first linkage portion of the linkage bar along the cam surface of the upper cam plate to in turn rotate the upper cam plate to effect a retraction of the deadbolt.

11. An interconnected door lock, comprising:

a latch bolt assembly having a latch bolt;

a latch bolt handle set that includes an exterior latch bolt operator having an exterior latch bolt handle and an interior latch bolt operator having an interior latch bolt handle, each of the interior latch bolt operator and the exterior latch bolt operator being operatively coupled to the latch bolt assembly to selectively operate the latch bolt;

a deadbolt assembly having a deadbolt;

a deadbolt operator set including an exterior deadbolt operator and an interior deadbolt operator, wherein each of the exterior deadbolt operator and the interior deadbolt operator is operatively coupled to the deadbolt assembly to selectively operate the deadbolt; and an interconnection assembly configured to interconnect the interior latch bolt handle to the deadbolt operator set, the interconnection assembly comprising:

a chassis defining a first rotational axis, a second rotational axis, and a pivot axis, the chassis having a first side and a second side facing in a direction directed away from the first side;

an upper cam plate rotatably coupled to the chassis to pivot about the first rotational axis, the upper cam plate being operatively coupled to the deadbolt, the upper cam plate having a cam surface, the upper cam plate being located entirely on the first side of the chassis;

a lower cam plate rotatably coupled to the chassis to pivot about the second rotational axis, the lower cam plate being operatively coupled to the interior latch bolt handle, the lower cam plate having an arcuate cam slot, the lower cam plate being located on the second side of the chassis; and a linkage bar rotatably coupled to the chassis to pivot about the pivot axis, the linkage bar having a first linkage portion and a second linkage portion that extend in opposite directions orthogonal to the pivot axis, the first linkage portion having a first cam follower configured to operatively engage the cam surface of the upper cam plate and the second linkage portion having a second cam follower operatively received in the arcuate cam slot of the lower cam plate.

12. The interconnected door lock of claim 11, wherein the chassis is in the form of an elongate plate, the linkage bar is located on the first side of the chassis, and the chassis having an opening through which the second cam follower is received.

13. The interconnected door lock of claim 11, wherein each of the first cam follower and the second cam follower is a pin that projects from a surface of the linkage bar in a direction substantially parallel to the pivot axis.

14. The interconnected door lock of claim 11, wherein the cam surface of the upper cam plate has a downwardly facing V-shape and the arcuate cam slot of the lower cam plate has an upwardly facing U-shape.

15. The interconnected door lock of claim 11, wherein the upper cam plate has a first wing portion and a second wing portion, the first wing portion being symmetrical to the second wing portion with respect to a centerline of the upper cam plate to define the cam surface as having a downwardly facing V-shape and with an apex of the V-shape located on the centerline.

16. The interconnected door lock of claim 11, wherein the cam surface of the upper cam plate has a downwardly facing V-shape that defines a first cam surface portion, a second cam surface portion, and an apex that joins the first cam surface portion with the second cam surface portion, wherein the first cam surface portion diverges from the second cam surface portion at the apex in an angular range of 140 to 160 degrees.

17. The interconnected door lock of claim 11, wherein the cam surface of the upper cam plate has a downwardly facing V-shape that defines a first cam surface portion, a second cam surface portion, and a central apex that joins the first cam surface portion with the second cam surface portion, and the arcuate cam slot defines an arcuate path having a first terminal end and a second terminal end spaced apart from the first terminal end, the first cam follower of the first linkage portion of the linkage bar configured to follow at least a portion of the V-shape of the cam surface as the first cam plate pivots about the first rotational axis, such that the linkage bar pivots about the pivot axis to reposition the second cam follower of the second linkage portion of the linkage bar in the arcuate cam slot of the lower cam plate.

18. The interconnected door lock of claim 17, wherein when the deadbolt is in a retracted position, the first cam follower of the first linkage portion of the linkage bar is positioned at the central apex of the cam surface of the upper cam plate, and the second cam follower of the second linkage portion of the linkage bar is positioned at a central portion of the arcuate cam slot of the lower cam plate.

19. The interconnected door lock of claim 18, wherein when the deadbolt is in an extended position, the first cam follower of the first linkage portion of the linkage bar is moved by the cam surface of the upper cam plate away from the central apex to one of the first cam surface portion and the second cam surface portion, and the second cam follower of the second linkage portion of the linkage bar is positioned at a corresponding one of the first terminal end and the second terminal end of the arcuate cam slot of the lower cam plate.

20. The interconnected door lock of claim 19, wherein with the second cam follower of the second linkage portion of the linkage bar positioned at a corresponding one of the first terminal end and the second terminal end of the arcuate cam slot of the lower cam plate, a rotation of the interior latch bolt handle about the second rotational axis results in a corresponding rotation of the lower cam plate about the second rotational axis to rotationally displace the arcuate cam slot relative to the second rotational axis and in turn invoke a counter rotation of the linkage bar about the pivot axis to reposition the first cam follower of the first linkage portion of the linkage bar along the cam surface of the upper cam plate to in turn rotate the upper cam plate to effect a retraction of the deadbolt.

21. The interconnected door lock of claim 11, wherein a conversion of the interconnected door lock from right-band to left-hand operation, or vice-versa, is achieved by changing a direction that each of the deadbolt of the deadbolt assembly and the latch bolt of the latch bolt assembly extends from the chassis.

22. The interconnected door lock of claim 11, wherein a conversion of the interconnected door lock from right-hand to left-hand operation, or vice-versa, is effected by rotating each of the deadbolt assembly and the latch bolt assembly by 180 degrees relative to the chassis.

* * * * *